US006035817A

United States Patent [19]

Uchida

[11] Patent Number: 6,035,817

[45] Date of Patent: Mar. 14, 2000

[54] VARIABLE VALVE TIMING MECHANISM FOR ENGINE

[75] Inventor: Masahiro Uchida, Iwata, Japan

[73] Assignee: Yamaha Hatsudoki Kabushiki Kaisha, Iwata, Japan

[21] Appl. No.: 09/195,356

[22] Filed: Nov. 19, 1998

[30] Foreign Application Priority Data

Nov. 19, 1997 [JP] Japan ..... 9-318051

[51] Int. Cl.[7] ..... F02F 1/24; F01L 1/344

[52] U.S. Cl. ..... 123/90.17; 123/90.34; 123/90.38; 123/196 A; 123/193.3

[58] Field of Search ..... 123/90.15, 90.17, 123/90.31, 90.33, 90.34, 90.38, 196 A, 193.5, 193.3, 195 C

[56] References Cited

U.S. PATENT DOCUMENTS

| | | | |
|---|---|---|---|
| 5,012,773 | 5/1991 | Akasaka et al. | 123/90.17 |
| 5,150,675 | 9/1992 | Murata | 123/193.5 |
| 5,189,999 | 3/1993 | Thoma | 123/90.17 |
| 5,301,639 | 4/1994 | Satou | 123/90.17 |
| 5,353,755 | 10/1994 | Matsuo et al. | 123/90.13 |
| 5,452,690 | 9/1995 | Kobayashi | 123/90.38 |
| 5,458,099 | 10/1995 | Koller et al. | 123/193.5 |
| 5,474,038 | 12/1995 | Golovatai-Schmidt et al. | 123/90.17 |
| 5,540,197 | 7/1996 | Golovatai-Schmidt et al. | 123/90.17 |
| 5,606,941 | 3/1997 | Trzmiel et al. | 123/90.15 |
| 5,669,343 | 9/1997 | Adachi | 123/90.17 |
| 5,713,319 | 2/1998 | Tortul | 123/90.17 |
| 5,718,196 | 2/1998 | Uchiyama et al. | 123/195 C |
| 5,797,363 | 8/1998 | Nakamura | 123/90.17 |
| 5,799,631 | 9/1998 | Nakamura | 123/90.17 |
| 5,829,399 | 11/1998 | Scheidt et al. | 123/90.17 |

*Primary Examiner*—Weilun Lo

*Attorney, Agent, or Firm*—Knobbe, Martens, Olson & Bear LLP

[57] ABSTRACT

A variable valve timing mechanism for an internal combustion engine wherein the camshaft is supported at one end by a combined bearing and valve body member that is detachably connected to the supporting engine body. The connection is such that fluid from the engine lubricating system can be delivered to this body and distributed by control valves mounted in it. This simplifies machining of the engine body and permits a more compact, lower cost construction without sacrificing any function.

18 Claims, 9 Drawing Sheets

VARIABLE VALVE TIMING MECHANISM FOR ENGINE

BACKGROUND OF THE INVENTION

This invention relates to an internal combustion engine and more particularly to an improved variable valve timing mechanism and control arrangement for such engines.

In order to improve the performance of an internal combustion engine and particularly those that are required to run over wide varieties of loads and speeds, such as is typical with automotive applications, it has been proposed to employ variable valve timing mechanisms (VVT). These VVT mechanisms are effective to change the timing of the events of opening and closing of the valves of the engine. They may be employed to either or both the intake and exhaust valves. By doing this, it is possible to change the valve timing in such a way so as to obtain optimum timing for a wider range of running variations.

Although various types of mechanisms have been employed for this purpose, those most commonly used normally employ a connection between a camshaft drive element and the camshaft which, when actuated, varies the phase angle between the camshaft drive element and the camshaft. Quite often, these devices are operated by hydraulic pressure.

The use of hydraulic pressure for operating the variable valve timing mechanism has a number of advantages. One of these advantages is that it permits the use of the lubricating system for the engine as a source of hydraulic pressure for operating the variable valve timing mechanism.

Generally, the mechanism includes a hydraulic supply line and a hydraulic return line which communicate with the engine lubricating system. A movable valve element controls the communication of these supply and return lines with the hydraulic actuator for the VVT mechanism. Thus, there are a fair number of components which must be employed in order to achieve the desired operation. Obviously, these mechanisms must be fairly accurate and also quite compact.

Normally, the camshaft is mounted directly in an engine body by journal surfaces formed in that engine body. The engine body is frequently but not always a cylinder head of the engine. Thus, it has been the practice to provide the engine body with supply and return lines and also a passage in which the controlling valve element can be mounted. This obviously gives rise to the necessity of machining the engine body in order to form these passages as well as the passage for the valve element.

It is, of course, possible to mount the valve element in the supply lines externally of the engine body, but this then complicates the overall engine construction and gives rise to the potential for leakage and misfit. However, to perform the necessary machining operations on the engine body itself can be quite complicated.

It is, therefore, a principal object of this invention to provide an improved and simplified arrangement for mounting a camshaft and for supplying fluid to a variable valve timing mechanism for the camshaft wherein a number of hydraulic passages and valve supporting passage are formed in a separate body that is detachably connected in a precise manner to the engine body.

It is also a principal object of this invention to provide an improved, simplified and easily machined variable valve timing actuating mechanism for an internal combustion engine.

From the foregoing description, it should be readily apparent that most hydraulically operated variable valve timing mechanisms utilize a valve element that is slidably supported in a body of the engine for controlling the operation of the variable valve timing mechanism. These valve elements are normally operated by means of a controlling element such as an electric servo motor or electric solenoid. This presents an additional problem in how the solenoid is mounted on the engine body.

Normally, the valve element that controls the flow of hydraulic fluid to and from the variable valve element reciprocates along an axis that is parallel to the axis of rotation of the camshaft. The actuating solenoid is, therefore, mounted on an external body of the engine and has a reciprocal axis that extends also parallel to the camshaft axis.

This, however, presents some spatial problems as will be best understood by reference to FIG. 1. This view is an enlarged, partial cross-sectional view showing a variable valve timing mechanism of the type utilized in prior art engines.

As may be seen, the engine includes a cylinder head 11. This cylinder head 11 supports a plurality of valves (not shown) that control the flow of gasses into and out of the engine combustion chambers. The cylinder head 11 has at one end thereof a bearing surface 12 that receives a bearing surface 13 of a cam shaft 14. The cam shaft 14 has a plurality of lobes (not shown) for operating the engine valves in any suitable manner.

A bearing cap 15 is detachably connected to the cylinder head 11 by fasteners 16 and completes the journaling of the camshaft 14 for rotation about a generally longitudinally extending axis that is parallel to the axis of rotation of the crankshaft of the engine. This crankshaft is not shown in FIG. 1.

However, the crankshaft has a driving timing sprocket that drives a chain 17 which is entrained around a driven timing sprocket 18 that is associated with the camshaft 14. A variable valve timing mechanism, indicated generally by the reference numeral 19, connects the driven sprocket 18 to the camshaft 14 so as to establish a driving relationship therebetween. This driving relationship is via a helical spline so that axial movement of a spline element will change the phase angle between the sprocket 18 and the camshaft 14. This causes variations in the valve timing, as is well known in this art.

The bearing surface 12 of the cylinder head 11 is formed by an upstanding boss 21 in which a hydraulic pressure line 23 is formed, which hydraulic pressure line is in communication with a high pressure pump for the engine lubricating system. This line 23 serves, among other things, to deliver lubricant to the bearing surface 12, the bearing surface 13 of the camshaft 14 and a corresponding bearing surface 24 of the bearing cap 15. These passages are formed adjacent a fastener 25 which is among the various fasteners employed to affix the cylinder head 11 to the cylinder block of the engine.

The pressure line 23 also communicates with a valve element, indicated generally by the reference numeral 26 that is slidably supported in a bore 27 formed in the cylinder head portion 22 and which controls the flow of fluid to and from a supply conduit 28 and a return conduit 29 that are associated with a control element (not shown) of the variable valve timing mechanism 19 for changing the aforenoted phase angle.

A solenoid motor 31 is affixed to the forward end of the cylinder head 11 and is coupled to the valve spool 26 for operating it. This solenoid 31 is operated by means of an ECU in accordance with any desired control strategy. This strategy is based primarily on engine speed and load.

As may be seen, the solenoid 31, because of its forwardly extending mounting, takes up space between the drive sprocket 18 and chain 17 and requires the variable valve timing mechanism 19 to be disposed at a substantially cantilevered distance L' from the threaded fastener 25. This also extends a substantial distance forwardly of the cylinder head so as to make the overall engine construction rather bulky.

It is, therefore, a still further object of this invention to provide an improved control arrangement for the variable valve timing mechanism of an internal combustion engine that permits a more compact construction.

It is a further object of this invention to provide a hydraulic control for a variable valve timing mechanism wherein an actuating solenoid for the valve element and/or the valve element itself can be positioned in a location that does not require extension of the camshaft drive mechanism and the variable valve timing mechanism from the journaled surface of the camshaft with which it is associated.

SUMMARY OF THE INVENTION

The invention is adapted to be embodied in an internal combustion engine variable valve timing mechanism that is comprised of an engine body assembly that defines a bearing surface for journaling a corresponding bearing surface of a camshaft. The camshaft has a portion that extends on one side of the engine body bearing surface and which contains a hydraulically operated, variable valve drive element for changing the phase angle between the camshaft and a camshaft drive element A hydraulic conduit extends through the engine body for supplying controlled hydraulic actuating fluid to the hydraulically operated variable valve timing drive element.

In accordance with a first feature of the invention, the portion of the engine body assembly that forms the bearing surface is formed as a separate element that is detachably connected to a main engine body element and in which the hydraulic conduit and an operating valve are mounted.

In accordance with another feature of the invention, the control includes a valve element that is movable along an axis that extends transversely to the axis of rotation of the camshaft.

DETAILED DESCRIPTION OF THE PREFERRED EMBODIMENT

Figure 1:
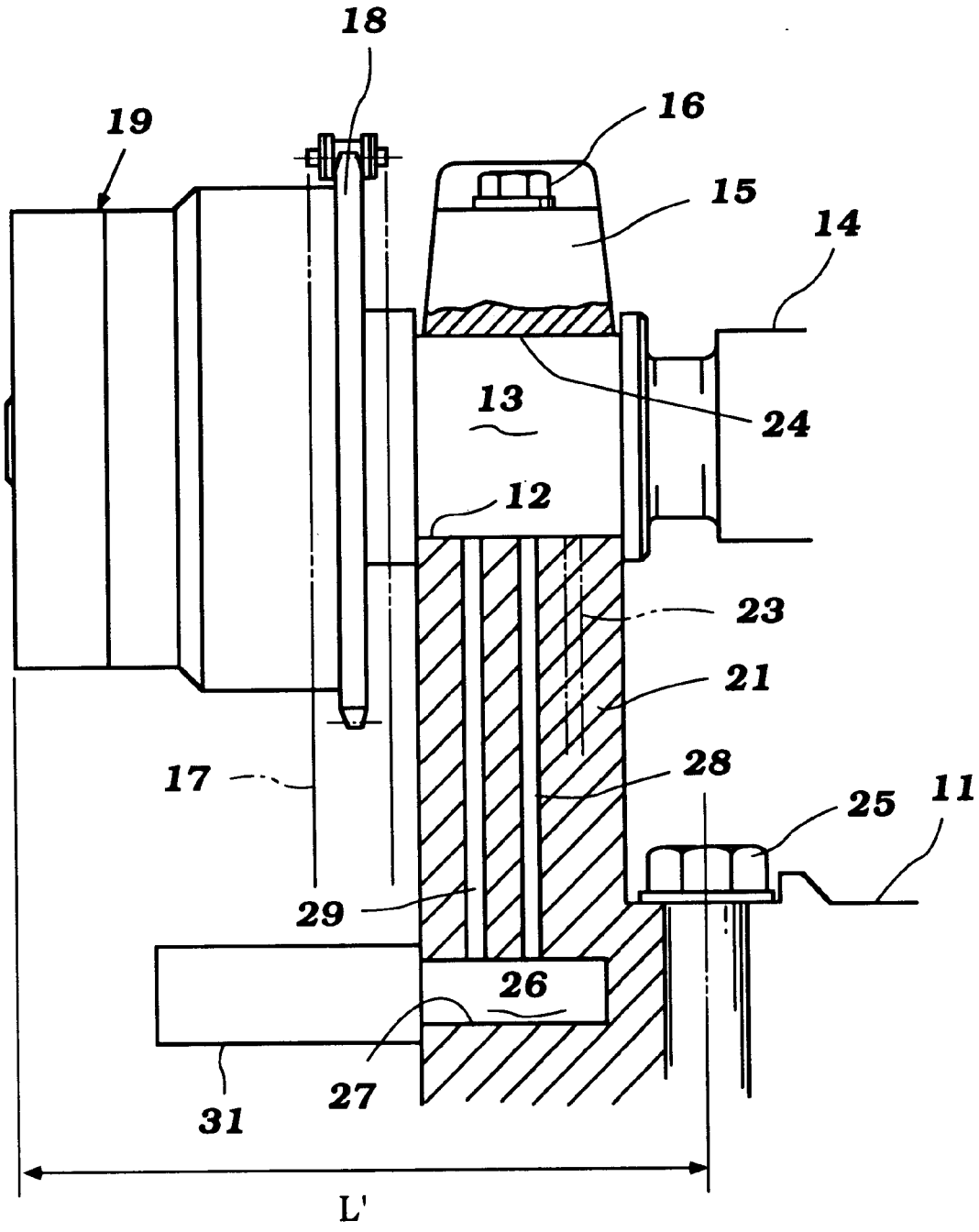
FIG. 1 is a partial view of a portion of a camshaft drive of a prior art type of engine construction with a portion broken away and shown in section.
Figure 2:
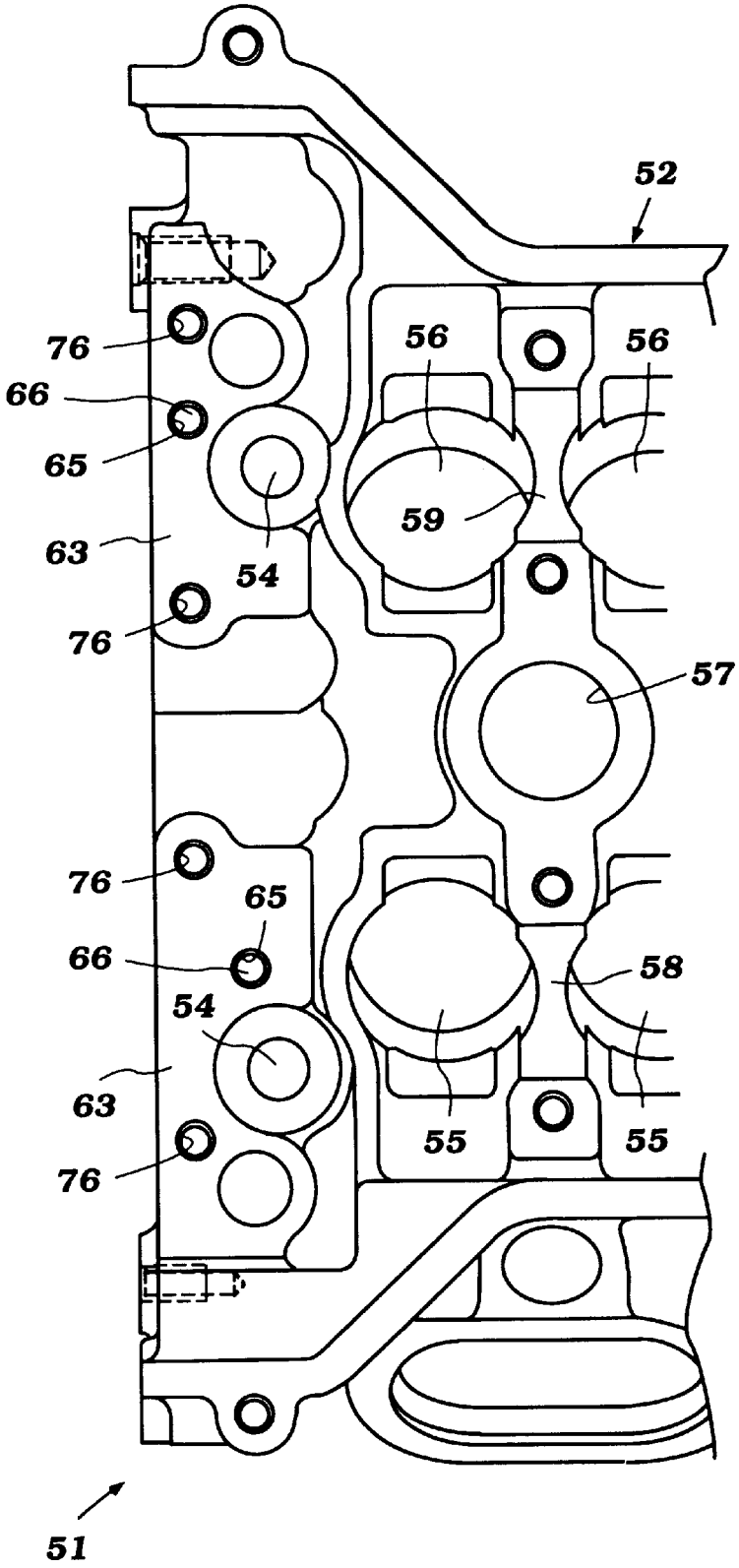
FIG. 2 is a top plan view of a cylinder head casting of an internal combustion engine that is constructed in accordance with an embodiment of the invention and with the remaining engine components removed so as to more clearly show the overall construction.

Referring now in detail to the drawings, inasmuch as the invention deals primarily with the variable valve timing mechanism and since this is embodied in a twin overhead camshaft internal combustion engine, only the cylinder head assembly of an engine constructed in accordance with an embodiment of the invention is illustrated. The cylinder head assembly is identified generally by the reference numeral 51. Also, although the invention is so illustrated, it should be apparent that the invention can be utilized with engines having other number of camshafts and other camshaft placements. The invention, however, has particular utility with overhead cam engines.

The cylinder head assembly 51 includes a main cylinder head casting 52 which has a lower surface 53 that is adapted to be brought into sealing engagement with an associated cylinder block (not shown). As such, the cylinder head surface 51 seals the area around the cylinder bores of the cylinder block. This surface 53 may be formed with suitably shaped recesses so as to cooperate with the desirably shaped head of the associated piston to form the desired combustion chamber configuration, as is well known in this art.

The cylinder head casting 52 is formed with a plurality of spaced openings 54 through which threaded fasteners (to be described later) extend so as to affix the cylinder head casting 52 to the cylinder block.

The cylinder head member 52 is formed with a plurality of tappet receiving bores 55 and 56 that are disposed on opposite sides of a longitudinally extending center plane that passes through the center of the cylinder bores that are sealed by the cylinder head assembly 51. These tappets are not shown, but as is well known in the art, these tappets operate the valves for the engine in a manner that is well known. For that reason, further description of the actual valve mechanism is not believed to be necessary to permit those skilled in the art to practice the invention. It should be noted, however, that in the illustrated embodiment, the engine is of the four valve per cylinder type, although this also may be varied to suit particular applications without departing from the spirit and scope of the invention.

Positioned centrally in the portion of the cylinder head casting 52 that lies over the cylinder bores is a spark plug receiving opening 57, one for each cylinder bore. Spark plugs (not shown) are received in these openings for firing a charge within the combustion chamber.

It should also be noted that the cylinder head casting 52 has beam portions that extend across the center area between the tappet receiving bores 55 and 56 associated with each cylinder. These form respective bearing surfaces 58 and 59 that cooperate with suitable bearing surfaces on intake and exhaust camshafts 61 and 62, respectively, so as to journal these camshafts 61 and 62 for rotation about parallel axes which are parallel to the axis of rotation of the engine crankshaft. Bearing caps (not shown) are affixed to the beam portions of the head casting 52 to complete this journalling.

Lobes are provided on the camshafts 61 and 62 that cooperate with the tappets that are received in the bores 55 and 56 for controlling the opening and closing of these valves in a manner that is well known in this art. To this point, the construction of the cylinder head assembly 51 may be considered to be conventional.

In accordance with a first feature of the invention, at one end of the cylinder head assembly 51, the cylinder head casting 52 is provided with a pair of spaced apart bearing pads 63 upon which a combined VVT valve operator and camshaft bearing plate 64 is supported. Each pad 63 is formed with an opening 65 for receiving a respective locating pin 66 (FIGS. 4 and 5) that cooperate with this plate 64 so as to provide accurate location for it. As may be best seen in FIGS. 3 and 4, the plate 64 provides a first bearing surface 67 that cooperates with a corresponding bearing surface 68 formed at the end of the intake camshaft 61. In a like manner, a second bearing surface 69 is formed that cooperates with a respective bearing surface 71 formed on the end of the exhaust camshaft 62.

Figure 4:
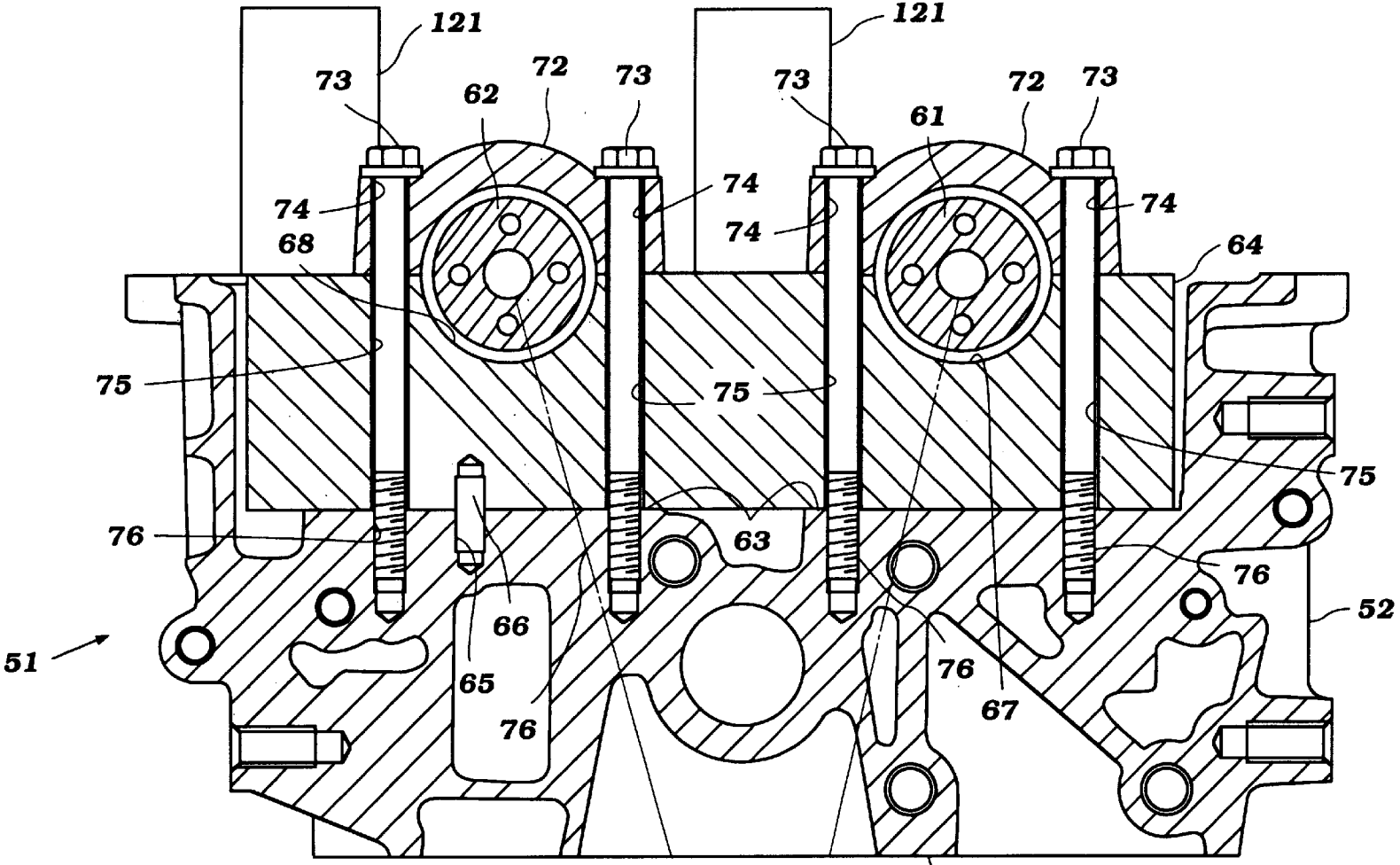
FIG. 4 is an enlarged cross-sectional view taken along the line 4—4 of FIG. 3.

Bearing caps 72 are affixed to the upper surfaces of the plate 64 by threaded fasteners 73 as best seen in FIG. 4 so as to fix these bearing caps 72 to the member 64. The bearing caps 72 have corresponding surfaces that cooperate with the camshaft bearing surfaces 68 and 71 for their journaling.

Figure 5:
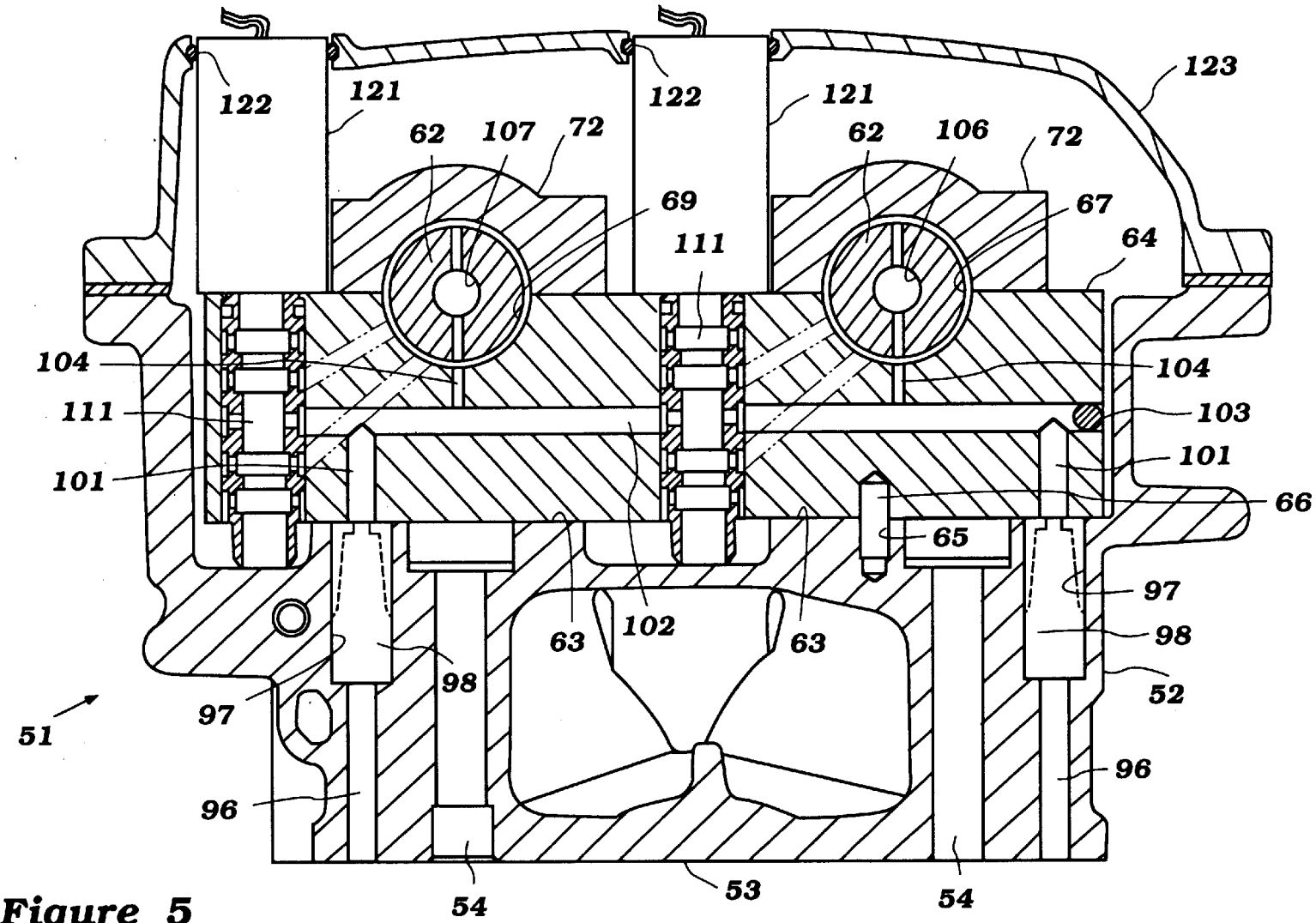
FIG. 5 is an enlarged cross-sectional view taken along the line 5—5 of FIG. 3.

As best seen in FIG. 5, the bearing caps 72 have openings 74 that pass the upper ends of the threaded fasteners 73. In a like manner, the plate 64 has openings 75 that pass these fasteners 73 so that the fastener 73 can be threaded into tapped openings 76 formed in the cylinder head casting 52. As a result, the combined valve and camshaft bearing plate 64 is affixed to and accurately located relative to the cylinder head casting 52.

Figure 3:
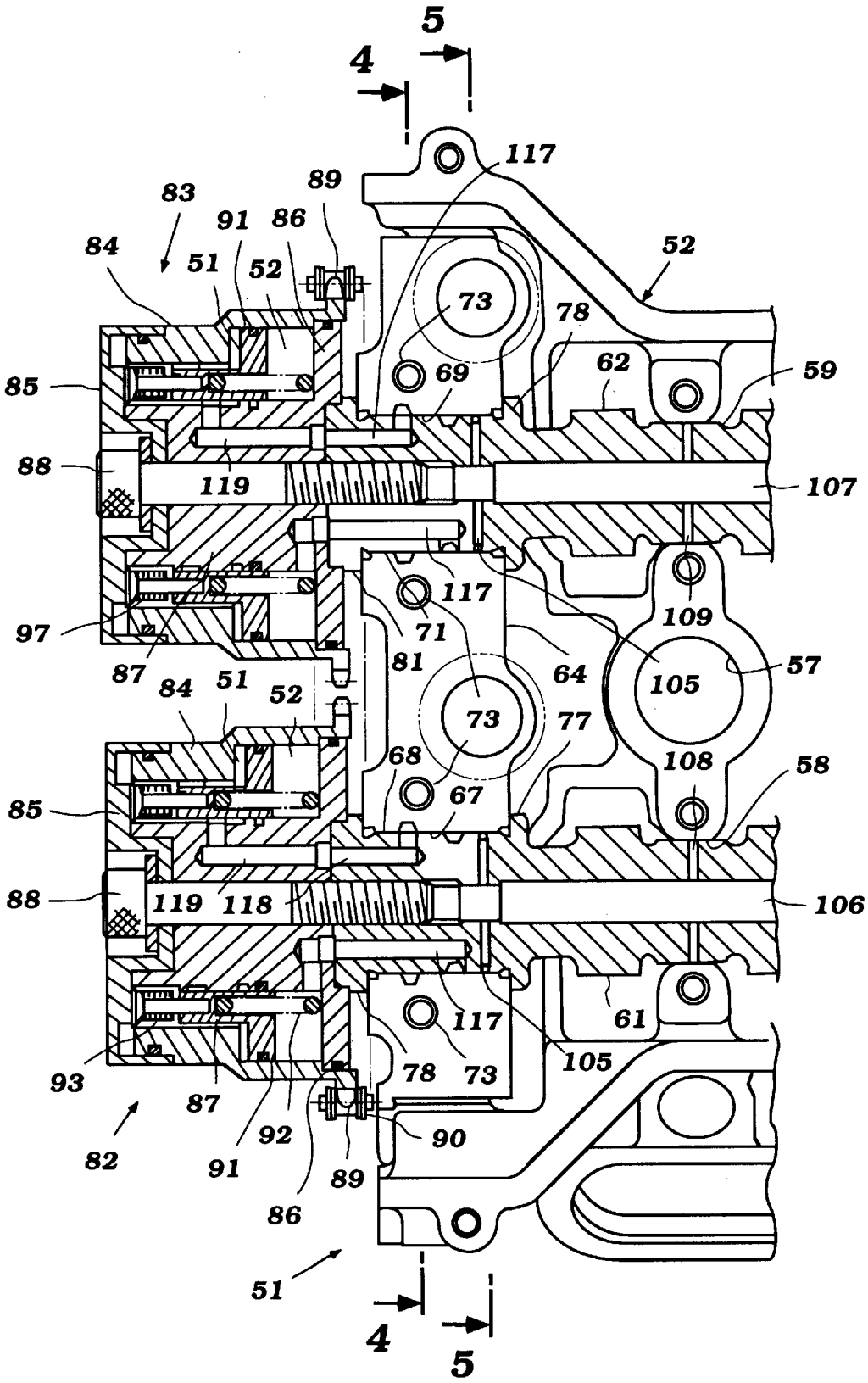
FIG. 3 is a view looking in the same direction as FIG. 2, but shows the elements of the cylinder head except for the bearing caps in place and with the camshaft and variable valve timing mechanism shown in cross section.

As may be best seen in FIG. 3, the intake and exhaust camshafts 61 and 62 have respective thrust bearing surfaces 77 and 78 that are engaged with the back surface of the plate 64 so as to provide axial location for these camshafts in the cylinder head. In a similar manner, thrust surfaces 79 and 81 are formed on the forward portions of the bearing surfaces 68 and 71 and engage the opposite side of the plate 64 so as to complete the axial location of these camshafts 61 and 62.

The intake and exhaust camshafts 61 and 62 are driven from the crankshaft through a drive mechanism that includes a pair of variable valve timing actuating mechanisms 82 and 83, respectively. The variable valve timing mechanisms 82 and 83 have the same construction insofar as their overall configuration is described, and thus, the component parts of each will be identified by the same reference numerals.

These mechanisms include an outer housing assembly that is comprised of a respective generally cylindrical member 84 which is closed at one end by an end wall member 85. The opposite end is closed by an outstanding flange 86 of an inner member 87 which is affixed in driving relationship to the respective camshaft 61 and 62 by means that include threaded fasteners 88. It should be noted that the outer housing member 84 and the inner member 87 are supported for relative rotation for a reason which will become apparent.

The outer members 84 are formed with integral sprocket teeth 89 that are engaged with a drive chain 90. The drive chain 90 is either driven directly or indirectly from the engine crankshaft so that the sprockets 89 will rotate at one-half crankshaft speed, as is well known in this art.

It has been noted that the inner and outer members 87 and 84 are supported for rotation relative to each other. By changing their rotational angles without interfering with the driving relationship, it is possible to change the valve timing, as is well known in this art. This is accomplished by providing a connection between the outer member 84 and inner member 87 that permits this phase change to be accomplished. This is done by providing a cylindrical piston 91 in a bore formed at one end of the outer member 84 adjacent the wall member 86 of the inner member 87. This piston 91 along with the outer member 84 defines first and second fluid chambers S1 and S2.

The piston 91 has a further inner portion that has a splined and helical connection between the outer member 84 and itself and between itself and the inner member 87 so that axial movement of the piston 91 will change the phase relationship.

Figure 6:
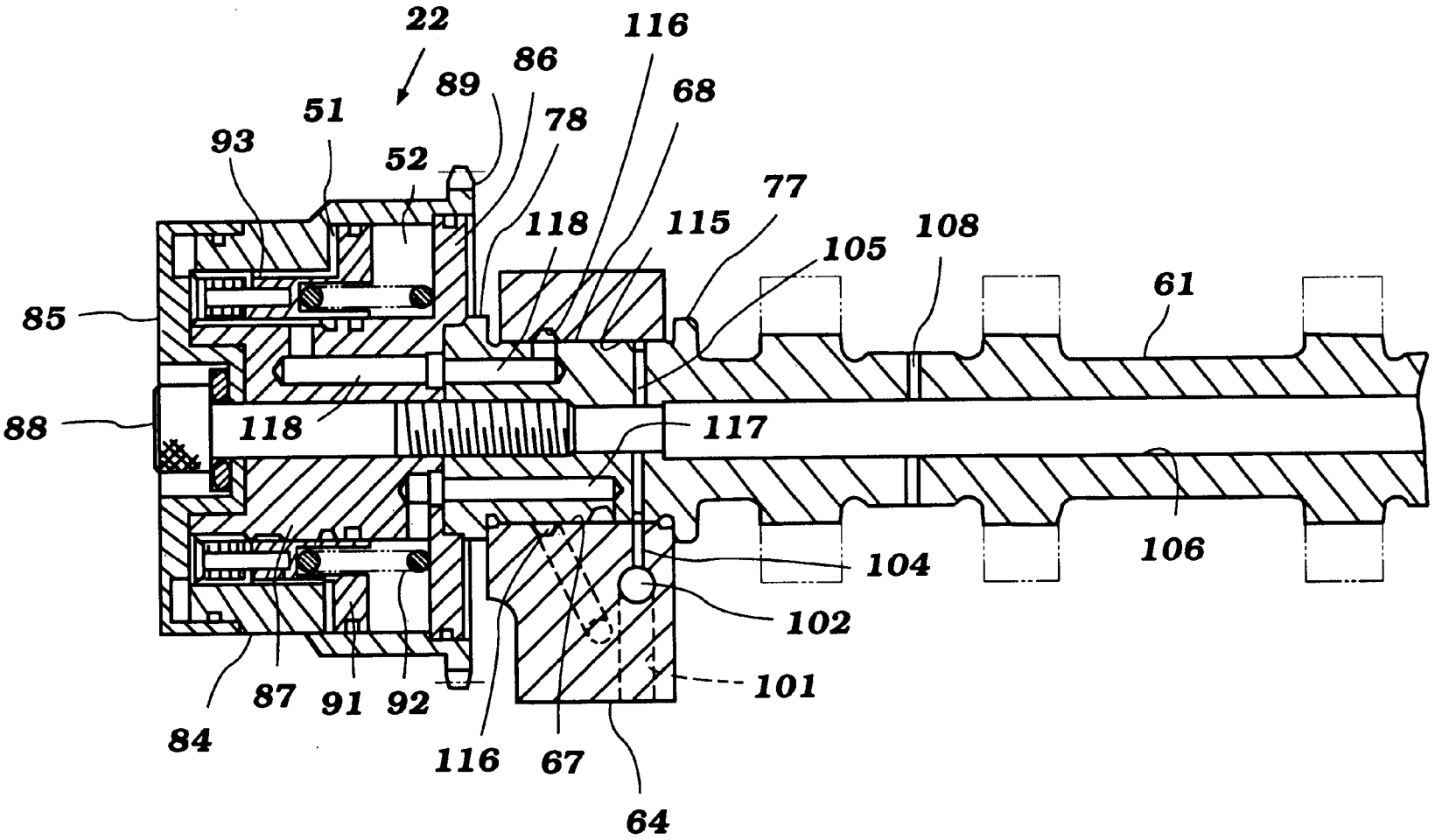
FIG. 6 is an enlarged cross-sectional view taken through one of the camshafts and is taken along a plane perpendicular to the planes of FIGS. 2 and 3.

A first, heavier coil spring 92 is received in the chamber S2 and urges the piston 91 to the left. A second lighter coil spring assembly 93 is provided that cooperates basically with the end of the inner piston portion in the volume S1 and urges the piston portion 91 to the right as seen in FIGS. 3 and 6. This spring arrangement 93 is considerably lighter than the spring arrangement 91 however.

By suitably pressurizing and relieving the chambers S1 and S2 respectively, the axial position of the piston 91 can be changed along with the phase relationship. This is done by a hydraulic mechanism that is powered by the lubricating system of the engine, in a manner which will now be described.

Figure 7:
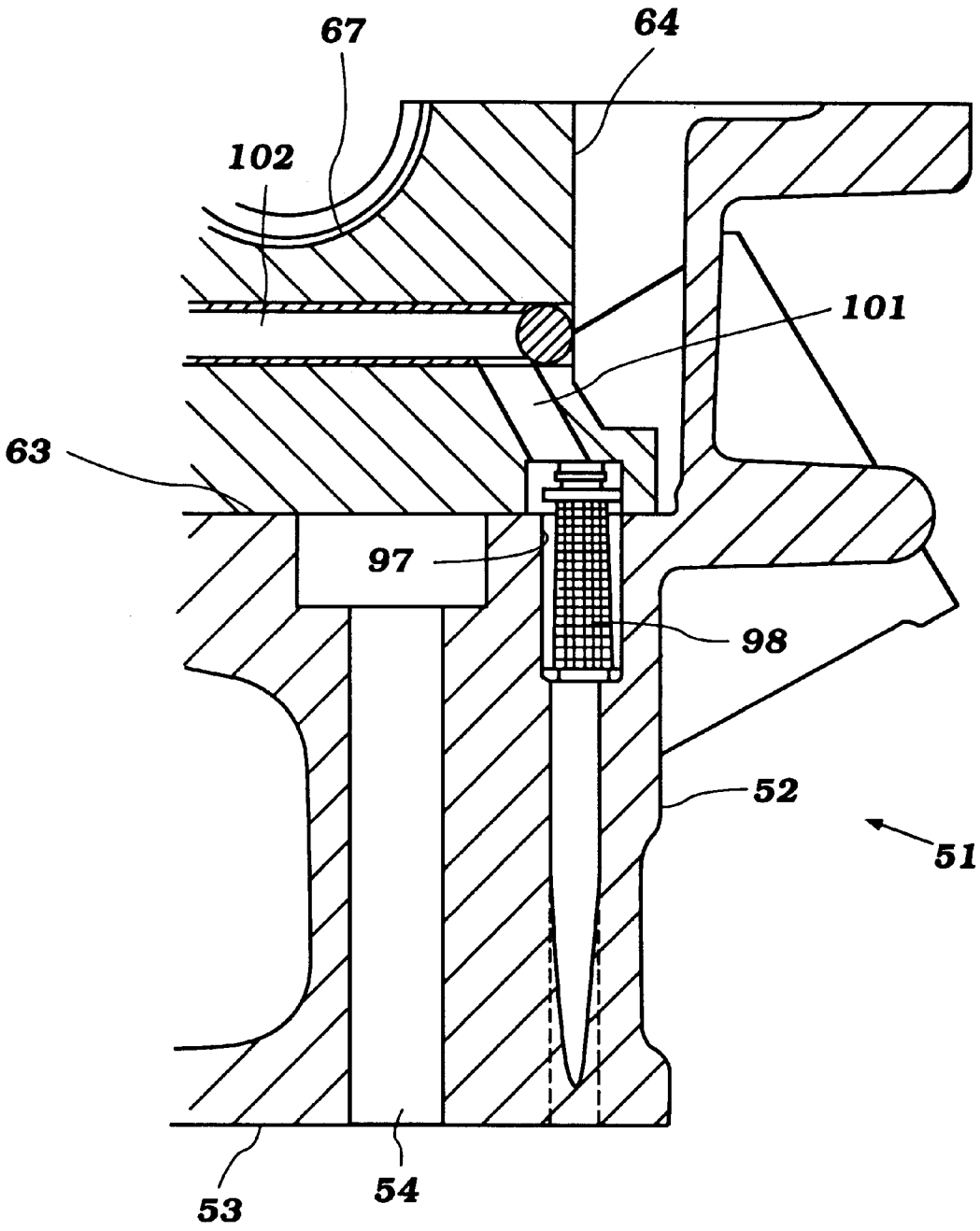
FIG. 7 is an enlarged cross-sectional view taken along a plane extending perpendicularly to the plane of FIG. 3 and through the communication of the cylinder block oil passages with the camshaft supporting element oil passages.
Figure 8:
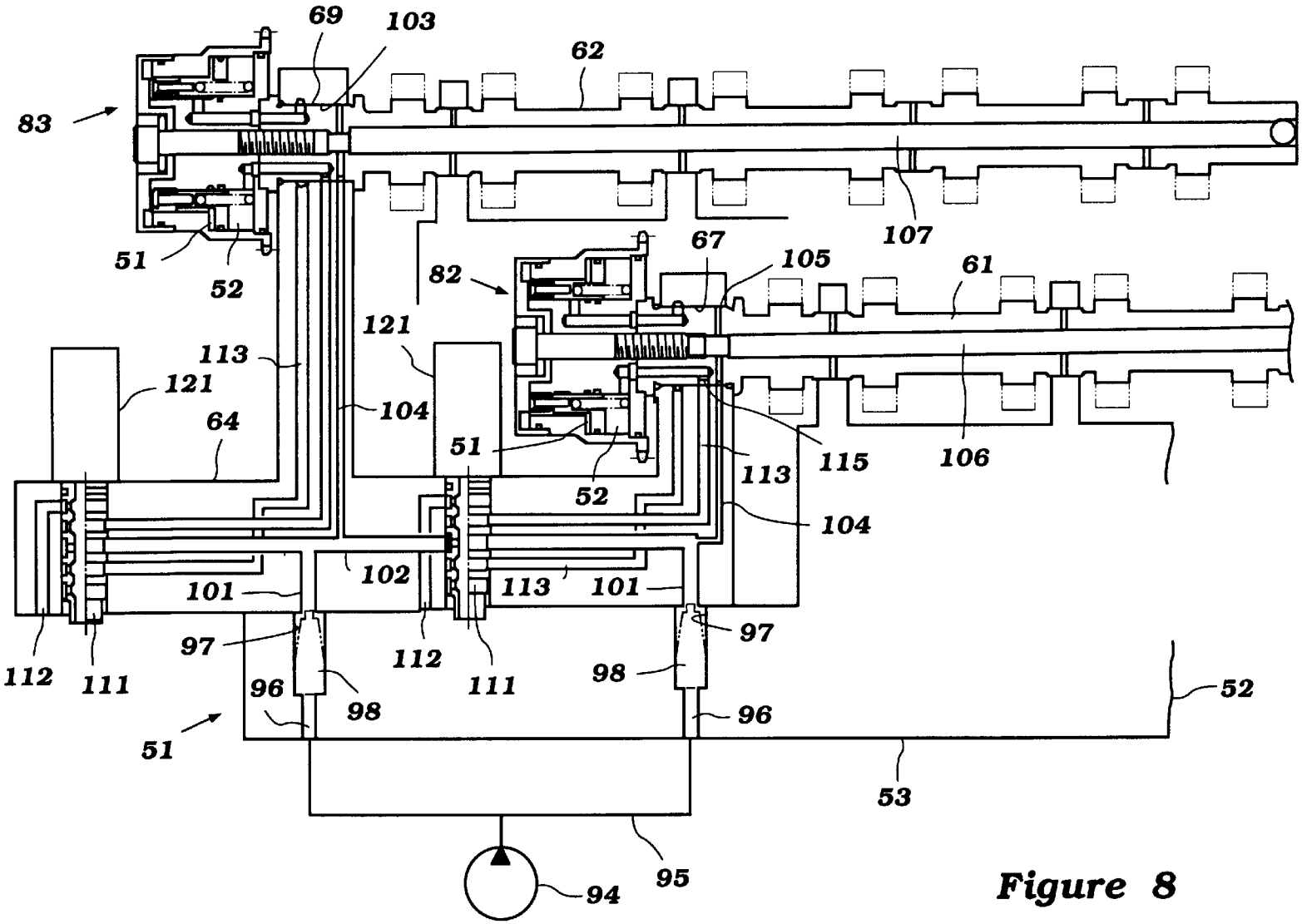
FIG. 8 is a partially schematic, partially cross-sectional view showing the hydraulic circuitry associated with the engine lubricating system and variable valve timing mechanism.

The hydraulic actuating system for the variable valve timing mechanisms 82 and 83 appear schematically in FIG. 8 and some of the details of the actual physical construction appear in FIGS. 3, 5, 6 and 7. First, the portion of the engine that is not illustrated includes a lubricating system including an oil pump 94 which is shown schematically in FIG. 8 and which pressurizes a main oil gallery 95 and distributing passages formed in the cylinder block of the engine with which the cylinder head assembly 51 cooperates.

As may be seen in this figure as well as in FIGS. 5 and 7, the main cylinder head casting 52 is formed with a pair of passages 96 that extend generally upwardly in the cylinder head casting 52 from its lower face 53 toward the combined camshaft bearing and valve plate 64. The lower ends of these passages 96 communicate with the main manifold 95 in the cylinder block in a suitable manner.

The upper ends of the passages 96 in the cylinder head casting 52 are formed with an enlarged diameter portions 97 in which a pair of filter elements 98 are trapped. The filter elements 98 each are held in place by means of recesses 99 formed in the lower end of the plate 64, as clearly seen in FIG. 7. This arrangement ensures that all lubricant that passes through the passages 96 will pass through the filter elements 98 before entering supply passages 101 formed in the lower end of the plate 64.

Each of these supply passages 101 have two branches. A first branch, consists of a main gallery branch 102 that extends generally transversely across the plate 64. This passage 102 may be formed by a drilling and its end is closed by a plug 103.

Further, drilled auxiliary branch passages 104 intersect the main gallery branches 102 and go to the bearing surfaces 67 and 69 which journal the intake and exhaust camshafts 61 and 62, respectively. These passages 104 also communicate with cross-drilled passages 105 formed in the camshafts 61 and 62, respectively, and which communicate with longitudinally extending oil galleries 106 and 107 formed in the camshafts 61 and 62. These passages are cross-drilled as at 108 and 109 so as to lubricate the various bearing surfaces spaced along the length of the camshafts 61 and 62 which are journaled in the cylinder head casting 52 itself.

The main galleries 102 of the member 64 also extend to respective spool valves, indicated generally by the reference numerals 111 that are supported within the plate 64 for reciprocation about axes that extend transversely to the axes of rotation of the intake and exhaust camshafts 61 and 62, respectively. These spool valves 111 are each associated with a respective one of the variable valve timing mechanisms 82 and 83.

The spool valves are also intersected by return passages 112 which will permit fluid to be dumped back from a respective one of the chambers S1 and S2 of the variable valve timing mechanisms 82 and 83 to the engine lubricating system return depending upon the position of the spool valve 111.

A pair of supply lines 113 and 114 are formed in the member 64 and extend to respective circumferential grooves 115 and 116 formed in the bearing caps 72 and bearing surface portions 67 and 69 of the plate 64. The circumferential grooves 115 communicate with a pressure passage 117 that extends axially along the respective camshafts and inner member 87 and which communicate with the chambers S2.

The grooves 116 communicate with passages 118 that communicate with passages 119 formed in the member 87 so as to supply or withdraw fluid from the chamber S1.

Thus, if the spool valves 111 are moved in one direction or the other, either the chamber S1 or the chamber S2 will be pressurized and the remaining chamber will be dumped back to the oil reservoir. In this way, the valve timing can be adjusted hydraulically.

Each spool valve 107 has associated with it a respective actuating solenoid 121. The solenoids 121 extend in the same direction as the axis of reciprocation of the valves 111, i.e., transversely to the axis of rotation of the camshafts 61 and 62. By virtue of this construction, the solenoid motors 121 may extend vertically upwardly and pass through respective gasket at openings 122 in a cam cover 123 that closes the valve mechanism of the cylinder head assembly 51 and which completes this assembly. Thus, the solenoids 121 the valves 111 may actually be removed for servicing without removing the cam cover 123.

It should be apparent that this construction provides a very compact assembly and also facilitates machining of the various passages in the plate 64 rather than in the cylinder head casting 52. In addition, the filters 98 can be easily serviced merely by removing the plate 64.

Figure 9:
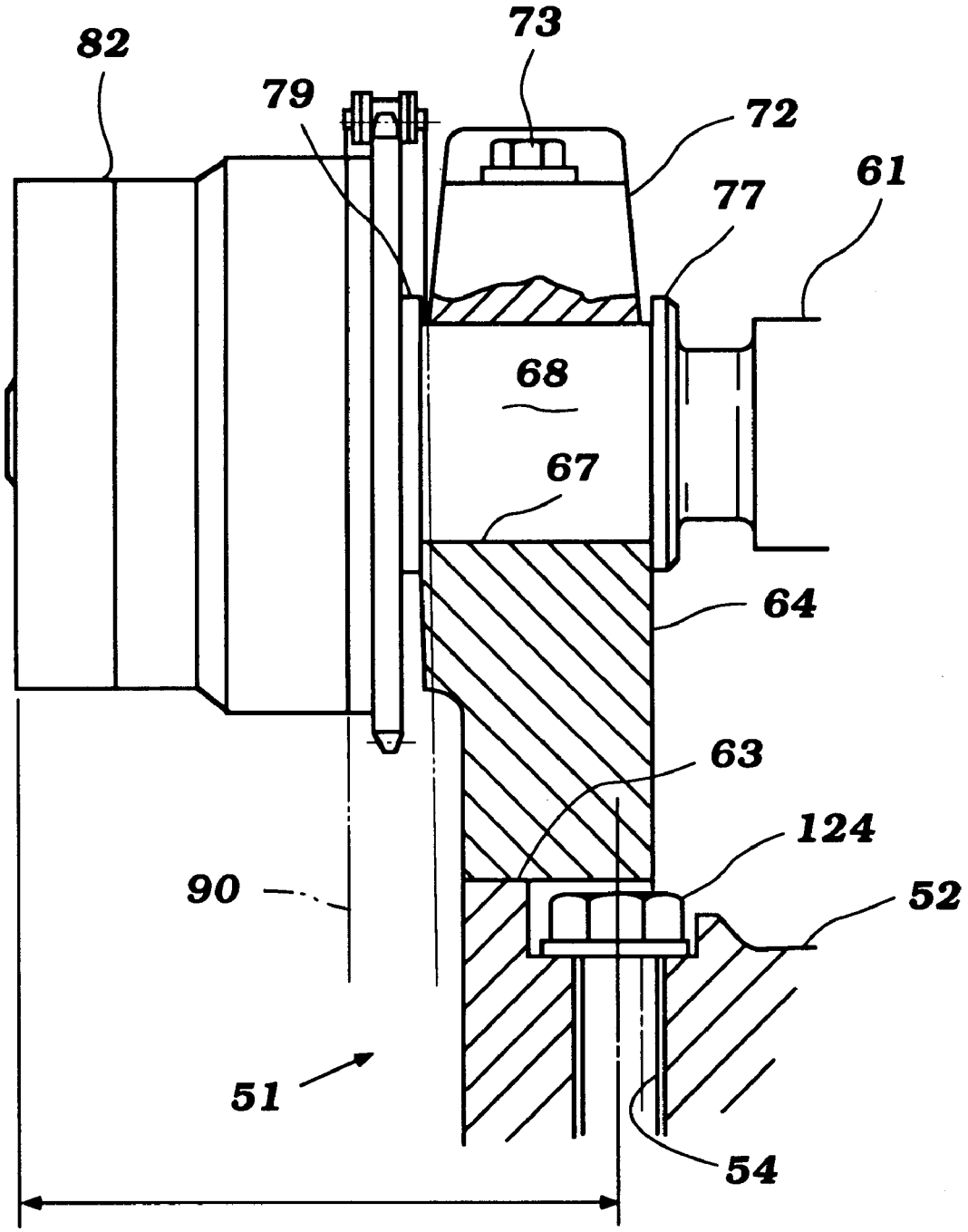
FIG. 9 is a view, in part similar to FIG. 1 and shows how this construction permits less cantilevering of the variable valve timing mechanism than the prior art type of construction.

As may be seen in FIG. 9, this construction permits the driving sprockets 89 to be positioned much closer to the bearing surface formed by the plate 64 and thus the length L is considerably less than the prior art type of construction relative to the cylinder head fasteners, indicated by the reference numeral 124.

It is to be understood, however, that the foregoing description is that of a preferred embodiment of the invention and that various changes and modifications can be made without departing from the spirit and scope of the invention, as defined by the appended claims.

I claim:

1. An internal combustion engine variable valve timing mechanism comprised of a cylinder head assembly defining a bearing surface for directly engaging and journaling a corresponding bearing surface of a camshaft, said camshaft having a portion that extends on one side of said engine body bearing surface, a hydraulically operated, variable valve drive element for changing the phase angle between the camshaft and a camshaft drive element associated with said camshaft portion, a hydraulic conduit extending through said cylinder head assembly for supplying controlled hydraulic actuating fluid to the hydraulically operated variable valve drive element, a segment of said cylinder head assembly bearing surface being formed by a separate engine body element that is detachably connected to a main cylinder head element and in which a portion of said hydraulic conduit is formed, a bearing member affixed to said separate engine body element and defining a remaining segment of cylinder head assembly bearing surface for directly engaging and journaling the corresponding bearing surface of the camshaft in cooperation with said engine body bearing surface segment, and an operating valve for controlling the supply of hydraulic fluid through said hydraulic conduit, said operating valve being mounted in said separate engine body element.

2. An internal combustion engine variable valve timing mechanism as set forth in claim 1, wherein the separate engine body element is detachably connected to one end of the main cylinder head element.

3. An internal combustion engine variable valve timing mechanism as set forth in claim 1, wherein the operating valve comprises a spool valve mounted for reciprocation along an axis.

4. An internal combustion engine variable valve timing mechanism as set forth in claim 3, wherein the reciprocal axis of the spool valve extends transversely to the axis of rotation of the camshaft.

5. An internal combustion engine variable valve timing mechanism as set forth in claim 4, further including a solenoid motor for actuating the spool valve.

6. An internal combustion engine variable valve timing mechanism as set forth in claim 5, wherein the solenoid motor is detachably mounted on the separate engine body element.

7. An internal combustion engine variable valve timing mechanism as set forth in claim 6, wherein the separate engine body element is detachably connected to one end of the main cylinder head element.

8. An internal combustion engine variable valve timing mechanism as set forth in claim 7, further including a cam cover affixed to the main cylinder head element and enclosing at least in part the separate engine body element.

9. An internal combustion engine variable valve timing mechanism as set forth in claim 8, wherein solenoid motor extends through an opening in the cam cover for removal of said solenoid motor without removal of said cam cover.

10. An internal combustion engine variable valve timing mechanism as set forth in claim 6, wherein the portion of the hydraulic conduit formed in the separate body element terminates in an inlet opening formed in an external surface thereof that is engaged with the main cylinder head element and which receives hydraulic fluid from said main cylinder head element.

11. An internal combustion engine variable valve timing mechanism as set forth in claim 10, further including a removable filter element positioned at the interface between the main cylinder head element and the separate engine body element.

12. An internal combustion engine variable valve timing mechanism as set forth in claim 11, wherein the separate engine body element is detachably connected to one end of the main cylinder head element.

13. An internal combustion engine variable valve timing mechanism as set forth in claim 12, wherein the hydraulically operated variable valve drive element is formed with a timing drive member driven by a crankshaft of the engine.

14. An internal combustion engine variable valve timing mechanism as set forth in claim 13, wherein the portion of the hydraulic conduit formed in the separate body element also extends to the bearing surface for delivering lubricant to the bearing surface.

15. An internal combustion engine variable valve timing mechanism as set forth in claim 1, wherein the portion of the hydraulic conduit formed in the separate body element terminates in an inlet opening formed in an external surface thereof that is engaged with the main cylinder head element and which receives hydraulic fluid from said main cylinder head element.

16. An internal combustion engine variable valve timing mechanism as set forth in claim 15, further including a removable filter element positioned at the interface between the main cylinder head element and the separate engine body element.

17. An internal combustion engine variable valve timing mechanism as set forth in claim 1, wherein the portion of the hydraulic conduit formed in the separate body element also extends to the bearing surface for delivering lubricant to the bearing surface.

18. An internal combustion engine variable valve timing mechanism as set forth in claim 17, wherein the hydraulically operated variable valve drive element is formed with a timing drive member driven by a crankshaft of the engine.

* * * * *